US008794392B2

(12) United States Patent
Kowatsch

(10) Patent No.: US 8,794,392 B2
(45) Date of Patent: Aug. 5, 2014

(54) RAPPELLING DEVICE

(75) Inventor: Ulrich Kowatsch, Leonberg (DE)

(73) Assignee: Spidescape Products, Inc., Bolder, CO (US)

( * ) Notice: Subject to any disclaimer, the term of this patent is extended or adjusted under 35 U.S.C. 154(b) by 984 days.

(21) Appl. No.: 12/278,210

(22) PCT Filed: Feb. 26, 2007

(86) PCT No.: PCT/EP2007/001637

§ 371 (c)(1), (2), (4) Date: Aug. 4, 2008

(87) PCT Pub. No.: WO2007/098907

PCT Pub. Date: Sep. 7, 2007

(65) Prior Publication Data

US 2009/0020373 A1 Jan. 22, 2009

(30) Foreign Application Priority Data

Mar. 1, 2006 (DE) ..... 10 2006 009 332

(51) Int. Cl.
*B65H 59/16* (2006.01)

(52) U.S. Cl.
USPC ..... 188/65.2; 188/65; 188/65.1; 188/65.4; 188/65.5; 188/77 W; 188/184; 182/5; 182/192; 182/234; 182/239; 242/419.4; 242/419.5

(58) Field of Classification Search
CPC ..... F16G 11/10; A62B 25/04; A62B 1/04; A62B 1/06; A62B 1/14; B66D 3/10; A63B 2208/12
USPC ..... 188/62.5, 77 W, 65.4, 65.5, 112 R; 182/234, 239, 241, 193, 5, 192; 242/419, 419.4, 419.5, 149, 151, 242/396.5–396.8
See application file for complete search history.

(56) References Cited

U.S. PATENT DOCUMENTS

| | | | | | |
|---|---|---|---|---|---|
| 338,750 | A | * | 3/1886 | Johnson | 182/192 |
| 383,340 | A | * | 5/1888 | Brice | 188/65.5 |
| 456,532 | A | * | 7/1891 | Bliss | 182/192 |
| 586,173 | A | * | 7/1897 | Frahm | 182/193 |
| 1,956,903 | A | * | 5/1934 | Kline | 114/199 |
| 2,122,315 | A | * | 6/1938 | Fosty et al. | 182/237 |
| 2,500,884 | A | | 3/1950 | Tessin | |
| 3,874,632 | A | | 4/1975 | Rago | |

(Continued)

FOREIGN PATENT DOCUMENTS

| | | |
|---|---|---|
| AT | 400 813 | 3/1996 |
| CA | 2 290 165 | 11/2000 |

(Continued)

*Primary Examiner* — Robert A Siconolfi
*Assistant Examiner* — San Aung
(74) *Attorney, Agent, or Firm* — Michael J. Striker

(57) ABSTRACT

In a rappelling device (10) for braking a load guided on a cable which can be fixed to the rappelling device (10), the cable (14) is friction-guided over a distance (22) and the cable (14) which runs through the rappelling device (10) is guided over a brakable shaft (24). The cable (14) is pressed onto the brakable shaft (24) by means of a pre-definable pressing force (29). The braking elements for the brakable shaft (24) can be kept small in weight and design because an additional braking of the cable (14) takes place over the friction-guided distance in the rappelling device (10).

13 Claims, 4 Drawing Sheets

(56) References Cited

U.S. PATENT DOCUMENTS

| | | | | | |
|---|---|---|---|---|---|
| 4,063,615 | A | | 12/1977 | Knepp | |
| 4,359,139 | A | * | 11/1982 | Bloder | 182/234 |
| 4,494,629 | A | * | 1/1985 | Raeburn | 188/65.5 |
| 4,662,475 | A | * | 5/1987 | Rutschi et al. | 182/5 |
| 4,722,422 | A | | 2/1988 | Hiraoka | |
| 5,083,633 | A | | 1/1992 | Seeger | |
| 5,701,972 | A | * | 12/1997 | Bloder | 182/234 |
| 5,722,612 | A | * | 3/1998 | Feathers | 242/381.5 |
| 6,029,777 | A | * | 2/2000 | Rogelja | 182/193 |
| 6,962,238 | B1 | | 11/2005 | Ostrobrod | |
| 2004/0118636 | A1 | | 6/2004 | Henson | |

FOREIGN PATENT DOCUMENTS

| | | |
|---|---|---|
| CH | 8030 | 1/1894 |
| DE | 59559 | 11/1897 |
| DE | 660 26 34 | 6/1969 |
| DE | 2 230 696 | 1/1974 |
| DE | 32 29 801 | 2/1984 |
| DE | 39 22 825 | 1/1991 |
| DE | 40 11 232 | 10/1991 |
| DE | 198 27 370 | 12/1999 |
| DE | 200 15 164 | 12/2000 |
| DE | 203 18 516 | 8/2004 |
| FR | 2 623 788 | 6/1989 |

* cited by examiner

RAPPELLING DEVICE

BACKGROUND OF THE INVENTION

The invention relates to a rappelling device for braking a load guided on a cable which can be fixed to the rappelling device.

A known device is disclosed in DE 203 18 516 U1 with the title "device for braking the take-off speed of a steel cable". The known device has a cable and brake drum in which the cable is guided with a plurality of loops. In one embodiment, the brake drum has centrifugal weights which abut against the inner side of a brake band in the event of braking when the rotational or unwinding speed is too high. If centrifugal brakes are used for these devices, which are intended to influence and predefine the rappelling speed of a load, these centrifugal brakes must be designed to be large so that they work safely and reliably. However, large centrifugal brakes are heavy. Thus, their handling is restricted. Disadvantages can arise here in rescue applications because fast and reliable handling is expected and necessary here. Furthermore, heavy rappelling devices are not easy to transport and handle.

SUMMARY OF THE INVENTION

The object of the invention is to provide a rappelling device which can be fitted with a small and light-weight brake and has the highest possible safety.

The object is achieved according to the invention by the cable running through the rappelling device in a friction-guided manner over a distance and being guided over a brakable shaft and by the cable being pressed onto the brakable shaft by means of a pre-definable pressing force.

The rappelling device according to the invention thus has the advantage that the brake of the shaft can be designed to be small because the brake of the shaft is assisted in its braking work by a friction-guided distance. The cable guided in the rappelling device is braked over the friction-guided distance by a pre-definable extent. Thus, the loading on the braking elements of the brakable shaft can be reduced. The braking elements can be designed to be lighter in weight or smaller that in rappelling devices which provide a brake for a shaft or a drum exclusively for speed-controlled guidance of a cable through a rappelling device. The braking effect is further improved by a pressing force which acts on the brakable shaft and whereby the cable is pressed onto the brakable shaft during its passage through the rappelling device. This therefore ensures controlled unrolling of such a cable pressed onto the brakable shaft. Uncontrolled slippage or sliding of the cable on the brakable shaft is reliably avoided.

If the cable is guided in a loop around the brakable shaft, wherein the loop can preferably have an angle of at least 180°, the cable can be effectively pressed onto the brakable shaft by means of the pressing force. In further embodiments, it is also possible for differently directed pressing forces to act on the cable pressing on the brakable shaft so that the cable can be guided free from slippage on the outer surface of the brakable shaft and unrolled in a controlled manner.

In a preferred embodiment of the invention, the friction-guided distance is embodied as a channel in the rappelling device which has a smaller diameter than the cable guided through the rappelling device and/or the cable is multiply deflected from its gravity-guided direction by means of rollers and/or bolts and/or the cable is guided through a wound channel, in particular in a meander shape or coiled, by the rappelling device.

The friction-guided distance can be configured as constructively different to assist the brakable shaft. It is important in this connection that on the one hand, the cable guided in the device is sufficiently braked by means of sufficient frictional energy and on the other hand, that the cable is not thermally overloaded in the braking process. Thus, the cable can be guided through the rappelling device over this distance over rigid bolts, mounted rollers, through constrictions and/or in a more or less curved fashion over guide elements, and cooling elements such as slots can be additionally provided on the device as required.

In all embodiments of the invention, only a maximum of one cable winding lies on the brakable shaft so that perturbations such as uncontrolled jamming of the cable as it runs through the rappelling device according to the invention are reliably avoided.

In a further embodiment of the invention, the rollers and/or bolts have a roughened outer surface and/or a material layer as an outer surface which has an increased coefficient of friction compared to the selected cable material.

This has the advantage that the friction-guided distance can be matched to a corresponding cable material used in order to achieve the best possible braking of the cable in the rappelling device.

It is particularly advantageous if the brakable shaft is braked by means of a centrifugal brake. Centrifugal brakes can be constructed compactly and reliably on the brakable shaft and prevent the cable from running through the rappelling device at too high speed. The brakable shaft can have a small diameter, thus producing high rotational speeds during braking. This makes it possible to use relatively small centrifugal brakes.

In another particular embodiment of the invention, the brakable shaft has a disk at one end which projects beyond the centrifugal brake and is encased by an elastic housing, preferably a housing made of plastic. This has the advantage that a hand brake is also provided on the rappelling device according to the invention in addition to the actual centrifugal brake. The hand brake is actuated via the elastic housing by pressing the elastic housing in the radial direction towards the outer circumferential surface of the disk, for example, with the finger pressure of one hand. The brakable shaft is thus stopped in a controlled fashion or its rotational speed is reduced in a controlled fashion.

If the disk additionally has gripping recesses or a handle, the disk can also be driven by hand if it is desirable for the cable to run faster past the brakable shaft.

The cable can be pressed particularly simply and effectively onto the brakable shaft by means of a spring-loaded roller. In this case, the spring can act directly on the roller or by means of a lever which presses the roller onto the cable and the cable onto the pressable shaft in a spring-loaded manner.

In a further embodiment of the invention, the braking device has a cable reservoir. This has the advantage that the rappelling device can be designed for certain areas of application in advance and produced ready for use.

If the rappelling device is to be used, for example, for fire protection on buildings, the cable reservoir can store that length of cable which is required to lower a person or a load reliably to the ground from the highest point of a building. In addition, the device according to the invention can be completely pre-installed, i.e. at one end the cable is affixed, for example, by means of a hook to the highest point of a building and the rappelling device is attached to the cable itself, having a load opening via which a load, if fixed there, can be rappelled reliably to the ground over a great height.

The rappelling device according to the invention can work particularly preferably if the brakable shaft is provided in the area of the cable entry into the rappelling device and if the friction-guided distance is adjacent thereto. This has the advantage that the brakable shaft is followed by a further braking path on which the cable guided through the device is braked. From the thermal point of view, the load on the braking elements of the brakable shaft is reduced. Likewise, smaller forces act on the braking elements which brake the brakable shaft during the braking process.

The cable can advantageously be embodied as plastic cable or as steel cable or as fibre composite cable. The fibre composite cable can be produced with and without fibres made of high-strength materials. However, other cables with any metal materials and fibre composite materials can be used with the rappelling device according to the invention.

In another embodiment, the rappelling device can be used in swinging operation, that is, the housing through which the cable runs in a controlled brakable manner is fixedly secured to a retaining element and loads can be rappelled at both cable ends in swinging operation. If one load is rappelled via the one free cable end, this one free cable end moves away from the housing in a controlled manner with the braking devices provided therein (braking means via frictional forces and centrifugal brake) and the other free cable end moves as close as possible to the housing of the rappelling device. When the rappelling process with the one free cable end has ended, a new rappelling process can be initiated with the other free cable end by running the cable in the opposite direction through the housing with the braking devices.

A hand wheel can be formed in the housing, whereby the braking action of the centrifugal brake can be influenced as far as completely stopping. This has the advantage that a load can be held at any height. If a person is being rappelled using the rappelling device according to the invention, the person can stop the rappelling process at any height and start again by stopping the centrifugal brake via the hand wheel or releasing this again. If the centrifugal brake is stopped by pressing the brake lining so strongly onto the corresponding brake-contact surfaces in the housing that no further cable movement is possible in the housing, the person being lowered has both hands free for other activities. If the rappelling process is to be continued, the centrifugal brake is released again by turning back the hand wheel and the rappelling process can be continued.

If the weights (persons, loads) to be lowered are too small for the selected rappelling device for the rappelling to function correctly, the turning movement of the brakable shaft can be assisted by a crank handle. This manually operated crank can counteract braking forces resulting from friction and/or centrifugal force.

Embodiments in which the desired braking action by the rappelling device is time-delayed and weight-related, relative to the load to be lowered are also advantageous. This has the advantage of avoiding jerky braking in cases of impact-like loading peaks caused by, for example, accelerating weights (persons jumping from a window of a building using a rappelling device according to the invention). In this case, it can be provided that, for example, loads over 200 kg on a cable are initially only gently braked and increasingly strongly with a time delay until the desired rappelling speed is set in a self-regulating manner by means of the centrifugal brake.

BRIEF DESCRIPTION OF THE DRAWINGS

The rappelling device according to the invention is described as an example with reference to exemplary embodiments in the following figures.

In the figures.

DETAILED DESCRIPTION OF THE PREFERRED EMBODIMENTS

Figure 1:
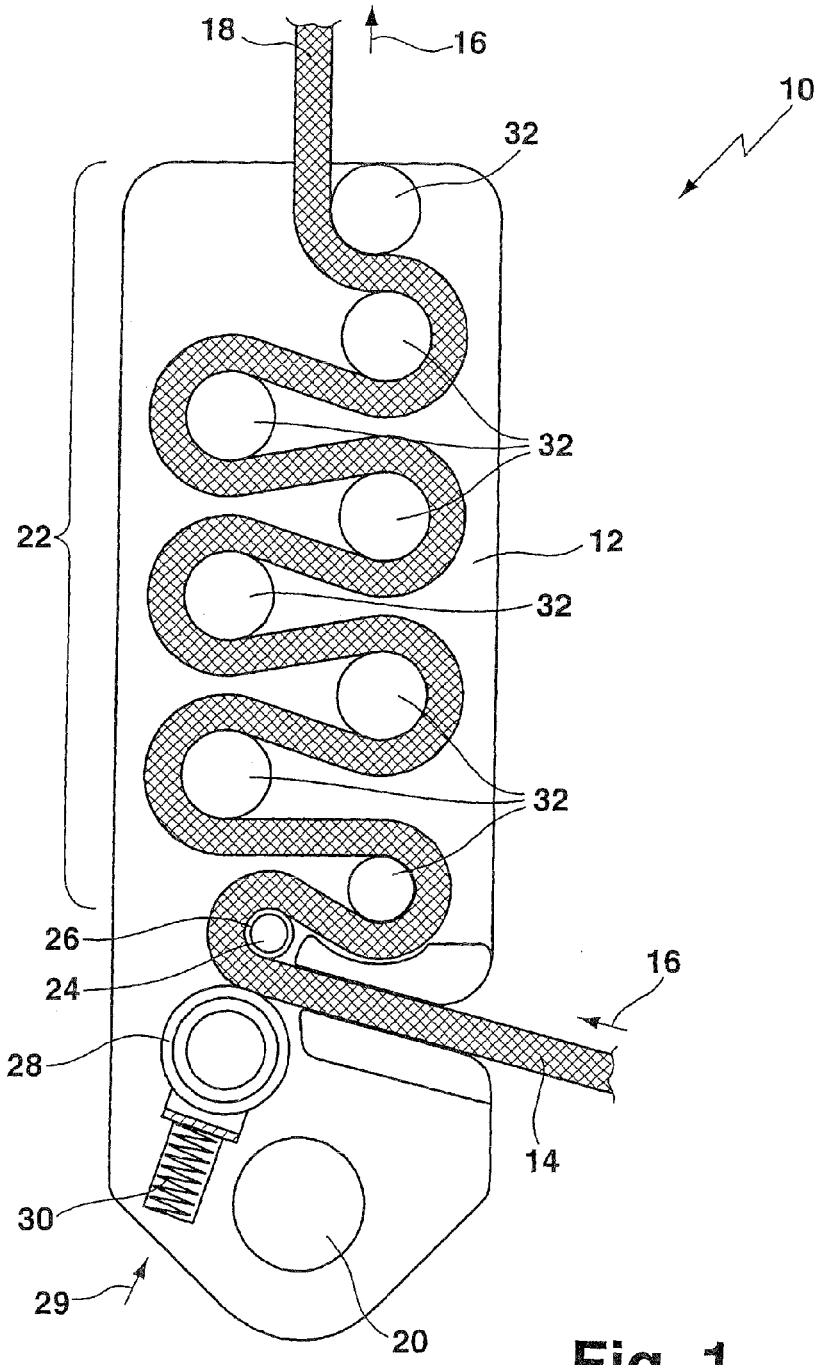
FIG. 1 is a rappelling device according to the invention in a highly schematic sectional view.

FIG. 1 shows a rappelling device 10 comprising a housing 12 in which a cable 14 is guided through the rappelling device 10 in the direction of the arrow 16. A hook, for example, not shown in the figure, is attached in the region 18 of the cable 14, and is used to attach the cable 14 in a fixed position, for example at the highest point of a building.

The rappelling device 10 has a through-hole 20 to which it is possible to fix a load to be lowered or a seat belt of a person, which are to be lowered by means of the rappelling device 10 from a higher point to a lower point. The rappelling device 10 has a friction-guided distance 22 which is directly adjacent to a brakable shaft 24 which is braked by means of a centrifugal brake. The cable 14 is guided over the brakable shaft 24 in such a manner that the cable can be pressed onto the brakable shaft 24 by means of a roller 28 with a pressing force 29. The pressing force 9, indicated by an arrow in the figure, is applied via a spring 30. The brakable shaft 24 has a coating or toothed structure 26 over which the loop of the cable 14 is guided reliably and free from slipping around the brakable shaft 24.

The friction-guided distance 22 is formed by means of bolts 32 which guide the cable 14 through the rappelling device in a multiply deflected, meander fashion. The cable 14 is braked in the desired fashion in the rappelling device 10 by means of the multiple deflections of the cable 14 and condition of the bolts 32.

Figure 2:
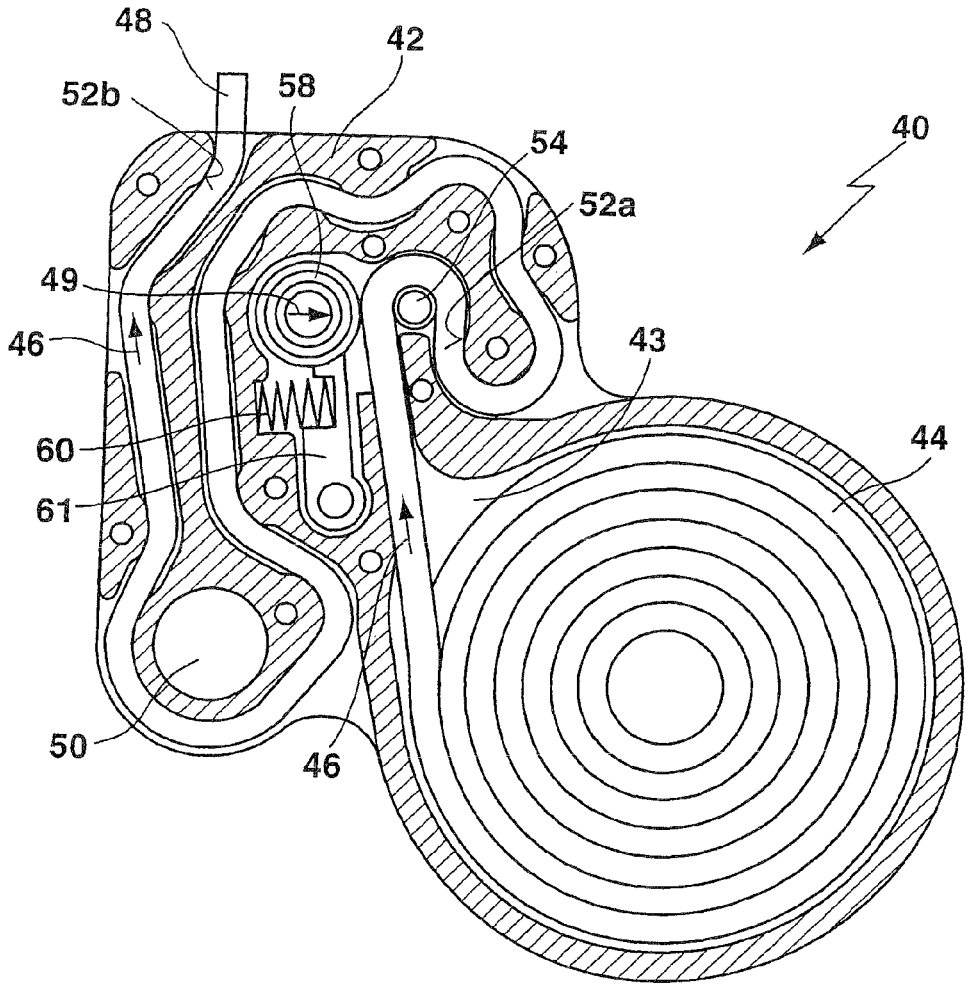
FIG. 2 is another embodiment of a rappelling device according to the invention also in sectional view with a cable reservoir.

FIG. 2 shows another embodiment of a rappelling device 40 according to the invention which comprises a housing 42 adjoining a cable reservoir 43 in which the cable 44 required for the rappelling device 40 is stored. The cable 44 can be pulled out from the cable reservoir 43 in the direction of the arrow 46 and run through other housing parts of the rappelling device 40. A retaining element, not shown in the figure, is attached to the cable 44 in the region 48, via which the cable 44 can be secured firmly for a rappelling process. The cable 44 is pressed onto a brakable shaft 54 by means of a pressing force 49, said shaft have a centrifugal brake as its brake. A through-opening 50 is formed on the housing of the rappelling device 40, by which means the load to be lowered by means of the rappelling device 40 can be fixed to the housing 42. A friction-guided distance 52*a* to 52*b* over which the cable 44 runs over curves is provided in the housing 42. The cable 44 is additionally braked over this distance.

The cable 44 runs around the brakable shaft 54 with a loop of at least 180°, the cable 44 being pressed against the brakable shaft 54 by means of a roller 58 which is loaded by means of a spring 60. The spring 60 presses against a hinged lever 61 in the housing 42 which presses the roller 58 onto the brakable shaft 54 with the pre-defined pressing force 49.

Figure 3:
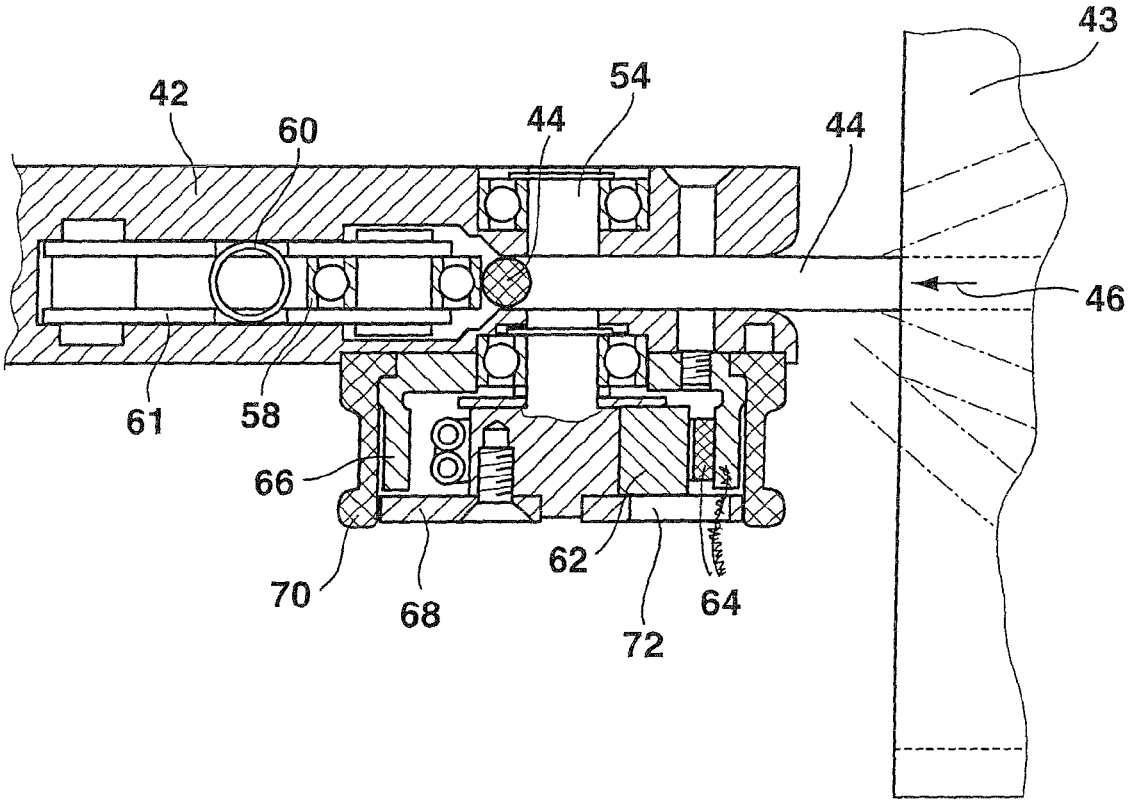
FIG. 3 is a section of the rappelling device according to FIG. 2 in a perpendicular view through the plane of the drawing.

FIG. 3 shows a section of the rappelling device 40 and this is in a section perpendicular to the plane of the drawing in FIG. 2. The cable 44 is guided from the cable reservoir 43 in the direction of the arrow 46 through the section of the housing 42 and is deflected by means of a loop around the brakable shaft 54. In the region of the brakable shaft 54, the cable 44 is pressed against the brakable shaft 54 by means of the roller 58. The desired pressure for the roller 58 is generated by means of the spring 60 which pivots the hinged lever 61 in the housing 42 in a spring-loaded manner.

The braking elements of the centrifugal coupling are formed on the brakable shaft 54. Weights 62 press on a brake lining 64 when the rotational speed of the brakable shaft 54 is high and suitably brake the rotational speed of the brakable shaft 54. The brake lining 64 is fixed to the weight 62.

A disk 68 which is connected rotationally fixedly to the brakable shaft 54 is formed at one end of the brakable shaft 54. The housing part 66 is encased by an elastic housing 70 in such a manner that during elastic deformation, it can be pressed onto the external circumferential surface of the disk 68. If the elastic housing 70 is so severely deformed by hand that a force acts on the outer circumferential surface of the disk 68, the rotational movement of the disk 68 and thus the brakable shaft 54 can be braked to a standstill. The brakable shaft 54 can be turned by hand with little expenditure of force by means of a gripping recess 72.

Figure 4:
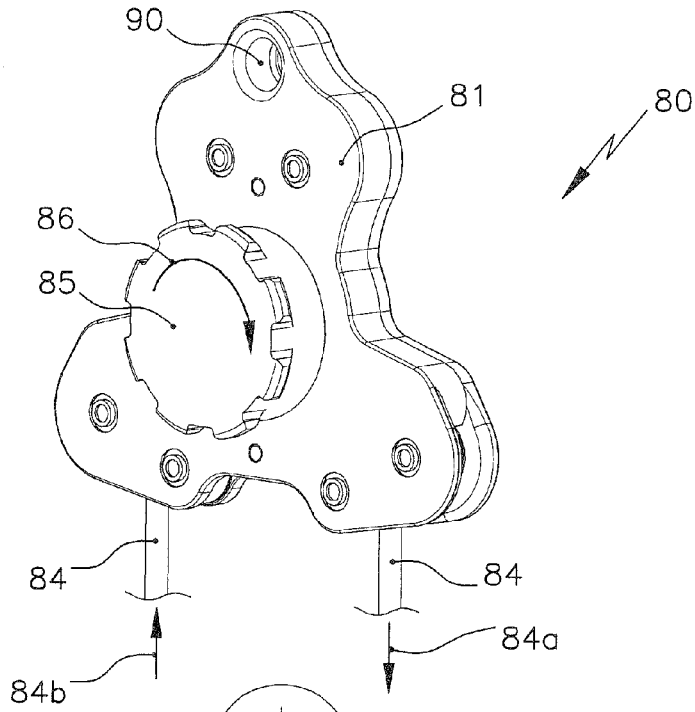
FIG. 4 is a rappelling device according to the invention suitable for swinging operation.

FIG. 4 shows a rappelling device 80 according to the invention which can be operated in swinging mode. A cable 84 runs through a housing 81 of the rappelling device 80 which has the braking means according to the invention. In the housing 81 the cable 84 is braked by frictional guidance and at the same time, is additionally braked by means of a centrifugal brake. The cable 84 can be guided out of the rappelling device 80 in the direction of the arrow 84*a* and at the same time, the cable 84 is guided into the housing 81 of the rappelling device 80 in the direction of the arrow 84*b*. The centrifugal brake can be blocked by means of a hand wheel 85 by turning the hand wheel 85 in the direction of the arrow 86 until the brake lining of the centrifugal brake brings the brakable shaft past which the cable 84 is running, completely to a standstill. When this state is achieved, a rappelling process is interrupted. The hand wheel 85 can be turned back in the opposite direction to the arrow 86 until the centrifugal brake releases the brakable shaft again to such an extent that a load fixed to the cable 84 can be lowered. For a rappelling process the housing 81 is firmly secured to a retaining element via a through-opening 90 formed on the housing 81.

Once a rappelling process has been completed by means of the cable in the direction of the arrow 84*a*, another rappelling process can take place on the cable 84 in the direction opposite to the arrow 84*b* by fixing a load to be lowered to this cable end. If the cable 84 is pulled from the housing 81 in the direction opposite to the arrow 84*b*, the cable 84 enters into the housing 81 in the direction opposite to the arrow 84*a*.

Figure 5:
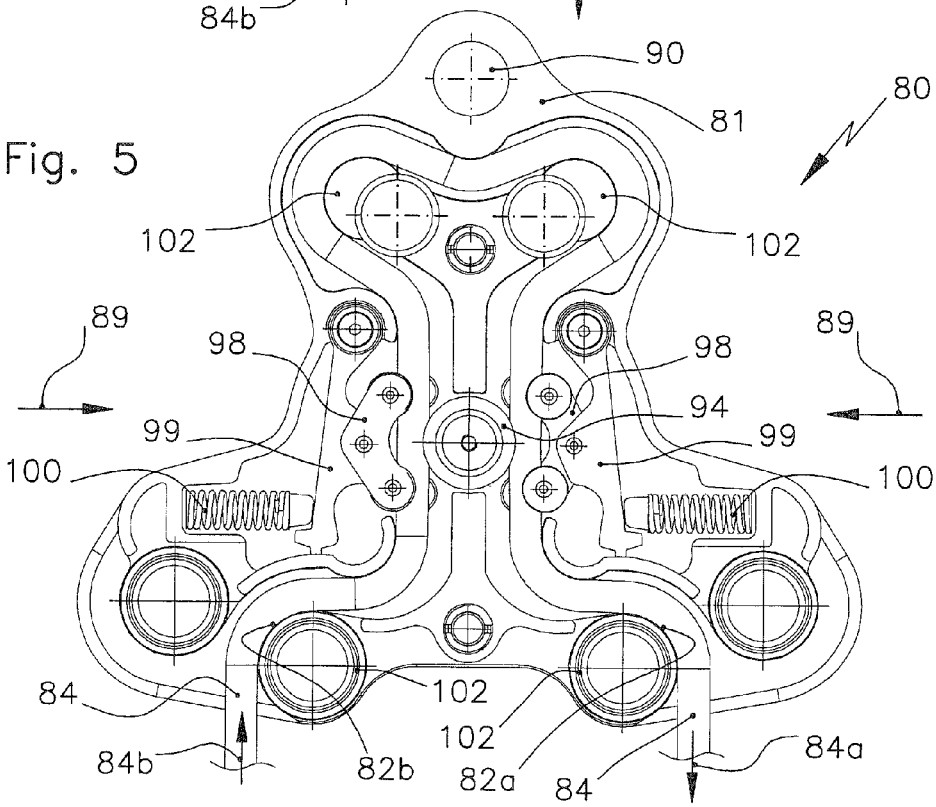
FIG. 5 is a sectional view of the rappelling device from FIG. 4.

FIG. 5 shows a section through a symmetrically constructed rappelling device 80, as shown in FIG. 4. The housing 81 comprises friction-guided distances 82*a* to 82*b* in which the cable 84 is braked as it runs through the housing 81. In addition, pressing forces 89 are applied in the housing 81, which press the cable 84 against a brakable shaft 94. The brakable shaft 94 can be braked by means of a centrifugal brake. Rollers 98, each hinged to a lever 99 are pressed against the brakable shaft 94 by means of springs 100. The cable 84 to be braked runs between the brakable shaft 94 and the rollers 98.

The cable 84 is forcibly guided in the housing 81 and is multiply deflected by means of bolts 102 or by means of rollers which guide the cable 84 through the housing 81 under friction loading.

The housing 81 has a symmetrical structure so that a rappelling process can be carried out simply in swinging operation. The housing 81 is fixed securely at the through-hole 90 to a building at the highest point of a rappelling process. When the cable 84 is guided through the housing 81 in the direction of the arrow 84*a*, the cable 84 simultaneously drawn into the housing 81 in the direction of the arrow 84*b*. The cable path in the housing 81 is constricted so severely or deflected so strongly by means of the bolts 102 or deflecting rollers that the cable 84 is braked in the housing 81 by means of friction. At the same time, the cable 84 is pressed so strongly against the brakable shaft 94 by means of the rollers 98 via the springs 100 that the rotational speed of the brakable shaft 94 determines the rappelling speed of a load affixed to the cable 84. The brakable shaft 94 is braked by means of a centrifugal brake and be stopped by means of a hand wheel if necessary or set additionally in rotation by means of a crank handle.

The cable 84 can run through the rappelling device 80 both in the direction of the arrows 84*a* and 84*b* and in the opposite directions of the arrows 84*a* and 84*b*.

In a rappelling device 10 for braking a load guided on a cable which can be fixed to the rappelling device 10, the cable 14 is friction-guided over a distance 22 and the cable 14 which runs through the rappelling device 10 is guided over a brakable shaft 24. The cable 14 is pressed onto the brakable shaft 24 by means of a pre-definable pressing force 29. The braking elements for the brakable shaft 24 can be kept small in weight and design because an additional braking of the cable 14 takes place over the friction-guided distance in the rappelling device 10.

The invention claimed is:

1. A rappelling device for braking a load guided on a cable (14; 44; 84) which can be fixed to the rappelling device, wherein the cable (14; 44; 84) runs through the rappelling device (10; 40; 80) in a friction-guided manner over a distance (22; 52*a*, 52*b*; 82*a*, 82*b*) defined by an arrangement of bolts and is guided over a single brakable shaft (24; 54; 94), wherein said brakable shaft includes a gearless centrifugal brake having a plurality of weights, wherein said weights of said brake are directly connected to the brakable shaft, wherein said brakable shaft has a small diameter that is configured to produce high rotational speeds during a braking process, wherein the brakable shaft is braked via the centrifugal brake, and wherein the cable (14; 44; 84) is pressed directly and so strongly onto the brakable shaft (24; 54; 94) having the small diameter by means of a pre-definable pressing force (29; 49; 89) that the rotational speed of the brakable shaft determines the rappelling speed of a load affixed to the cable.

2. The rappelling device according to claim 1, wherein the friction-guided distance (22; 52*a*, 52*b*; 82*a*, 82*b*) is embodied as a channel in the rappelling device (10; 40; 80) which has a smaller diameter than the cable (14; 44; 84) guided through the rappelling device (10; 40; 80) and/or that the cable (14; 44; 84) is multiply deflected from its gravity-guided direction by means of rollers and/or bolts (32; 102) and/or that the cable (14; 44; 84) is guided through a wound channel, in particular meander-shaped or coiled, by the rappelling device (10; 40; 80).

3. The rappelling device according to claim 2, wherein the rollers and/or bolts (32; 102) have a roughened outer surface and/or a material layer as outer surface which has an increased coefficient of friction compared to the selected cable material.

4. The rappelling device according to claim 1, characterised in that the brakable shaft (24; 54) has a disk (68) at one end which projects beyond the centrifugal brake and is encased by an elastic housing (70), preferably a housing made of plastic.

5. The rappelling device according to claim 4, characterised in that the disk (68) has gripping recesses (72).

6. The rappelling device according to claim 1, wherein the cable (14; 44; 84) is pressed onto the brakable shaft (24; 54; 94) by means of a spring-loaded roller (28; 58; 98).

7. The rappelling device according to claim 1, characterised in that the braking device (10; 40) has a cable reservoir (43).

8. The rappelling device according to claim 1, wherein the brakable shaft (24; 54) is provided in the area of the cable entry into the rappelling device (10; 40) and that the friction-guided distance (22; 52*a*; 52*b*) is adjacent thereto.

9. The rappelling device according to claim 1, wherein the cable (14; 44; 84) is a plastic cable, a steel cable, a fiber composite cable with and without carbon fibers or a cable (14; 44; 84) comprising other metal and/or fiber composite materials.

10. The rappelling device according to claim 1, characterised in that the rappelling device (80) can be used in swinging mode.

11. The rappelling device according to claim 1, characterised in that the rappelling device (10; 40; 80) comprises a braking device, in particular a hand wheel (85) for completely stopping the brakable shaft (24; 54; 94).

12. The rappelling device according to claim 1, wherein that a crank handle is provided on the brakable shaft (24; 54; 94) via which the brakable shaft (24; 54; 94) can be driven.

13. The rappelling device according to claim 1, wherein the brakable shaft (24; 54; 94) builds up the desired braking force depending on weight over a time interval.

* * * * *